US011236873B2

(12) United States Patent
Mackin

(10) Patent No.: US 11,236,873 B2
(45) Date of Patent: Feb. 1, 2022

(54) DOCK LIGHT APPARATUS

(71) Applicant: Tri Lite, Inc., Chicago, IL (US)

(72) Inventor: Michael P. Mackin, Chicago, IL (US)

(73) Assignee: TRI LITE, INC., Chicago, IL (US)

( * ) Notice: Subject to any disclaimer, the term of this patent is extended or adjusted under 35 U.S.C. 154(b) by 0 days.

(21) Appl. No.: 16/890,902

(22) Filed: Jun. 2, 2020

(65) Prior Publication Data

US 2020/0386378 A1 Dec. 10, 2020

Related U.S. Application Data

(60) Provisional application No. 62/857,070, filed on Jun. 4, 2019.

(51) Int. Cl.
*F21S 8/00* (2006.01)
*F21V 21/30* (2006.01)
*F21W 131/402* (2006.01)

(52) U.S. Cl.
CPC ..... *F21S 8/036* (2013.01); *F21V 21/30* (2013.01); *F21W 2131/402* (2013.01)

(58) Field of Classification Search
CPC ... F21S 8/036; F21V 21/108; F21W 2131/107
See application file for complete search history.

(56) References Cited

U.S. PATENT DOCUMENTS 2,280,402 A * 4/1942 Greppin ..... F21V 11/00 362/293
3,696,240 A 10/1972 Potter
4,473,874 A * 9/1984 Warshawsky ..... F21V 21/26 248/284.1
4,818,170 A 4/1989 Fisher et al.
D359,225 S 6/1995 Reed
5,709,458 A 1/1998 Metz
D393,921 S 4/1998 Cicolello et al.
6,652,114 B2 11/2003 Ancel
6,781,516 B2 8/2004 Reynard et al.
6,812,849 B1 11/2004 Ancel
7,101,064 B2 9/2006 Ancel
7,533,431 B2 5/2009 Hochstein
D608,047 S 1/2010 Scheper et al.
D620,165 S 7/2010 Huang
D636,927 S 4/2011 Lin
7,988,327 B1 * 8/2011 Knoble ..... H05B 45/00 362/235
D657,905 S 4/2012 Yu
D657,906 S 4/2012 Yu
8,366,301 B2 2/2013 Hudson et al.
8,590,087 B2 11/2013 Swessel et al.
D729,964 S 5/2015 Huh
9,255,699 B2 2/2016 Wiegel et al.
D755,430 S 5/2016 Waldmann
D818,177 S * 5/2018 Amato ..... D26/87
D832,488 S 10/2018 Yu et al.
D847,410 S 4/2019 Stanley
(Continued)

*Primary Examiner* — Sean P Gramling
(74) *Attorney, Agent, or Firm* — Michael Best & Friedrich LLP

(57) ABSTRACT

A dock light apparatus comprises a light fixture and an elongated arm including an axially straight portion coupled to an axially curved portion having a rigid bend. The straight portion is configured to mount to a wall and the curved portion is configured to support the light fixture.

20 Claims, 13 Drawing Sheets

(56) References Cited

U.S. PATENT DOCUMENTS

| | | | |
|---|---|---|---|
| D856,114 | S | 8/2019 | Poppell |
| D874,710 | S | 2/2020 | Tong |
| D888,317 | S | 6/2020 | Amato et al. |
| D893,790 | S | 8/2020 | Ng et al. |
| D907,842 | S | 1/2021 | Mackin |
| 2003/0151912 | A1 | 8/2003 | Ancel |
| 2003/0151913 | A1 | 8/2003 | Ancel |
| 2003/0197622 | A1 | 10/2003 | Reynard et al. |
| 2003/0199996 | A1 | 10/2003 | Reynard et al. |
| 2005/0028723 | A1 | 2/2005 | Aneel |
| 2005/0102042 | A1 | 5/2005 | Reynard et al. |
| 2005/0168999 | A1 | 8/2005 | Sommers et al. |
| 2008/0010757 | A1 | 1/2008 | Hochstein et al. |
| 2010/0320918 | A1 | 12/2010 | Hudson et al. |
| 2011/0075441 | A1 | 3/2011 | Swessel et al. |
| 2011/0203059 | A1 | 8/2011 | Whitley et al. |
| 2014/0225509 | A1 | 8/2014 | Avalos |
| 2016/0075526 | A1 | 3/2016 | Avalos |

* cited by examiner

DOCK LIGHT APPARATUS

BACKGROUND

The present disclosure relates to a dock light apparatus.

To increase visibility and safety during loading and unloading of tractor trailers at a warehouse loading dock, dock lights are used to illuminate trailer interiors that do not have interior lights. Dock lights typically are mounted adjacent to a loading dock door in the interior of the loading dock and include a light source that can be positioned to direct lighting into the interior of a docked trailer.

SUMMARY

In one embodiment, the disclosure provides a dock light apparatus including an elongated bent arm having a rigid bend, a light fixture mounted proximate to a distal end of the bent arm, and a bracket assembly mounted at a proximal end of the bent arm.

Other aspects of the disclosure will become apparent by consideration of the detailed description and accompanying drawings.

DETAILED DESCRIPTION

Figure 1:
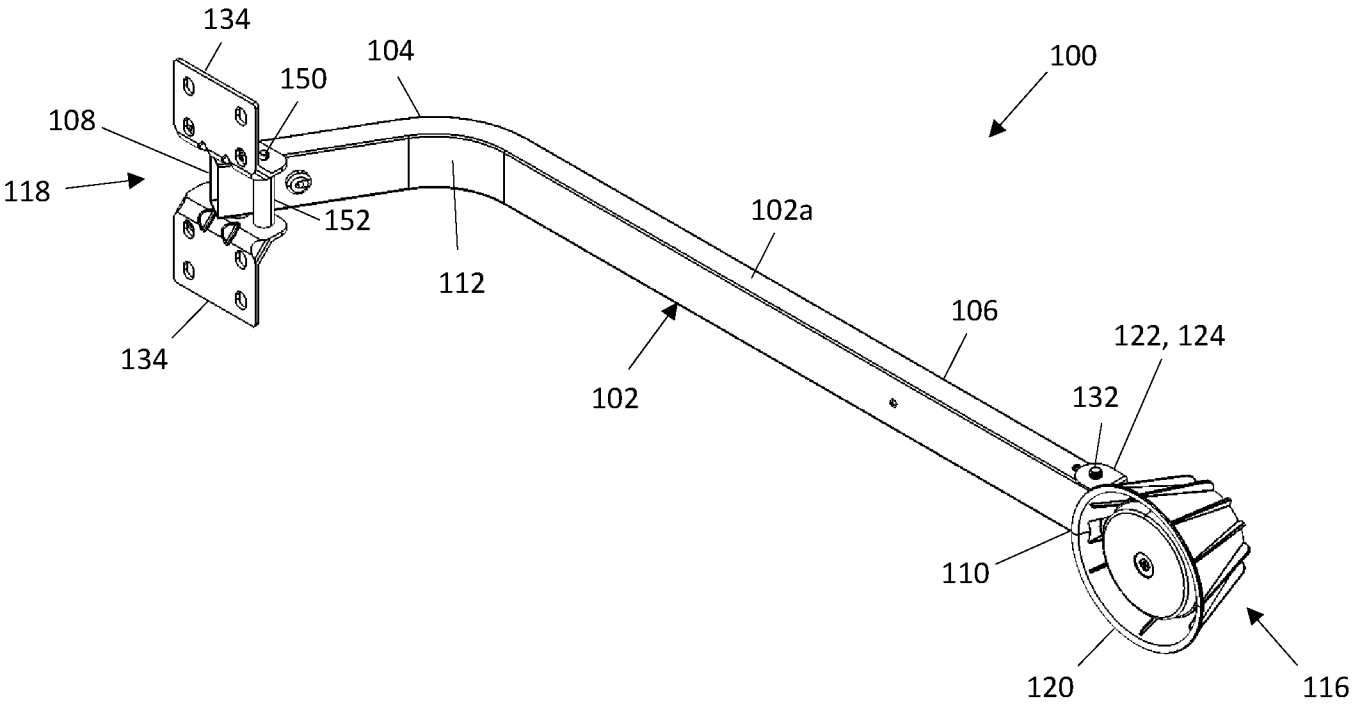
FIG. 1 is a perspective view of a dock light apparatus in accordance with an embodiment of the present disclosure.
Figure 2:
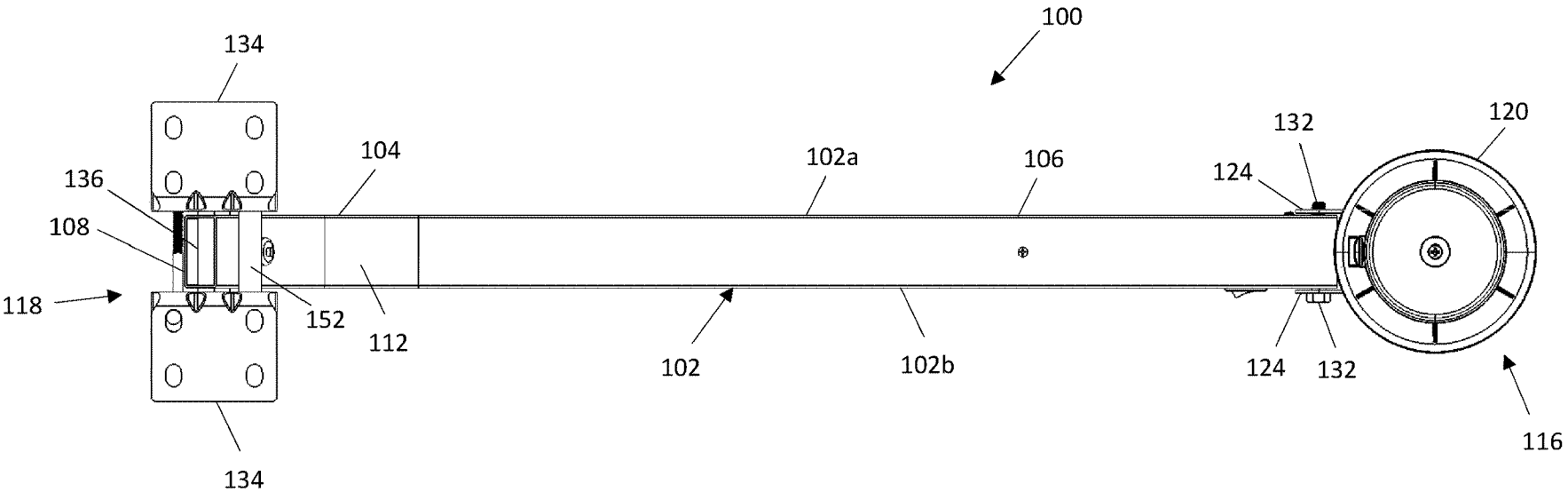
FIG. 2 is a front view of the dock light apparatus of FIG. 1.
Figure 3:
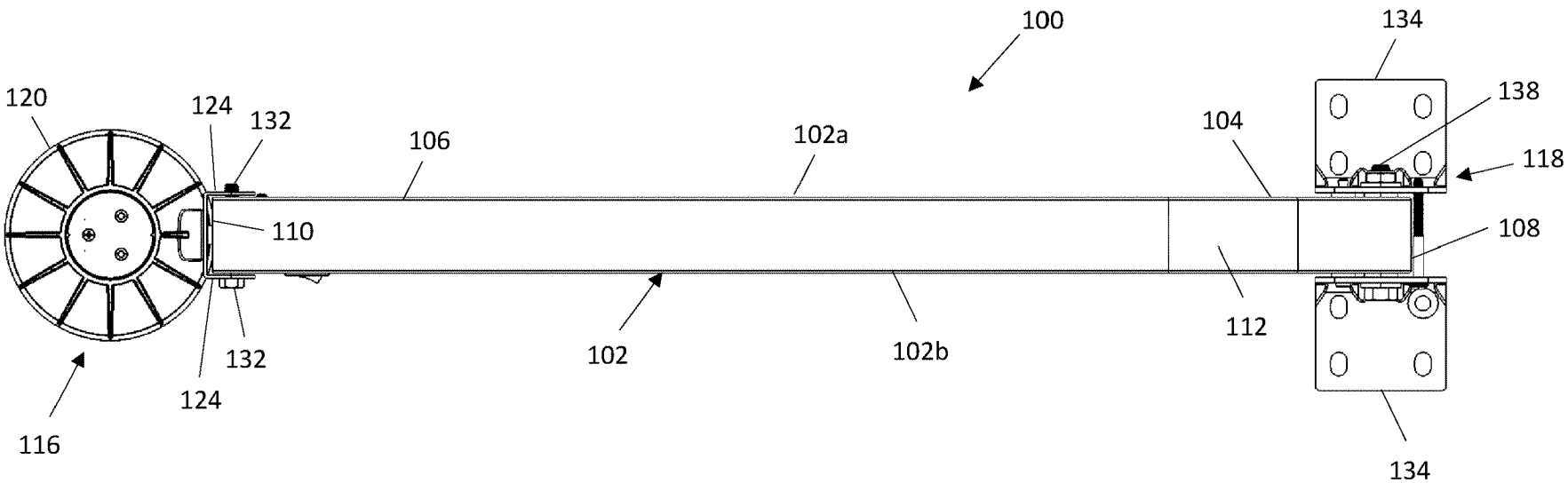
FIG. 3 is a rear view of the dock light apparatus of FIG. 1.
Figure 4:
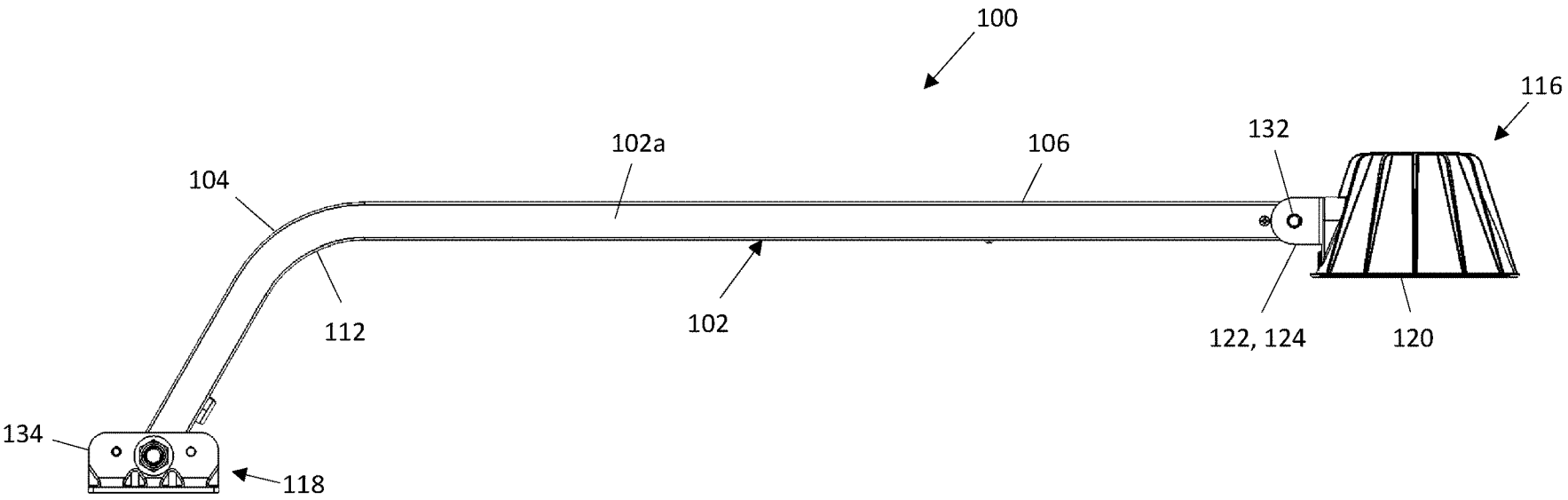
FIG. 4 is a top view of the dock light apparatus of FIG. 1.
Figure 5:
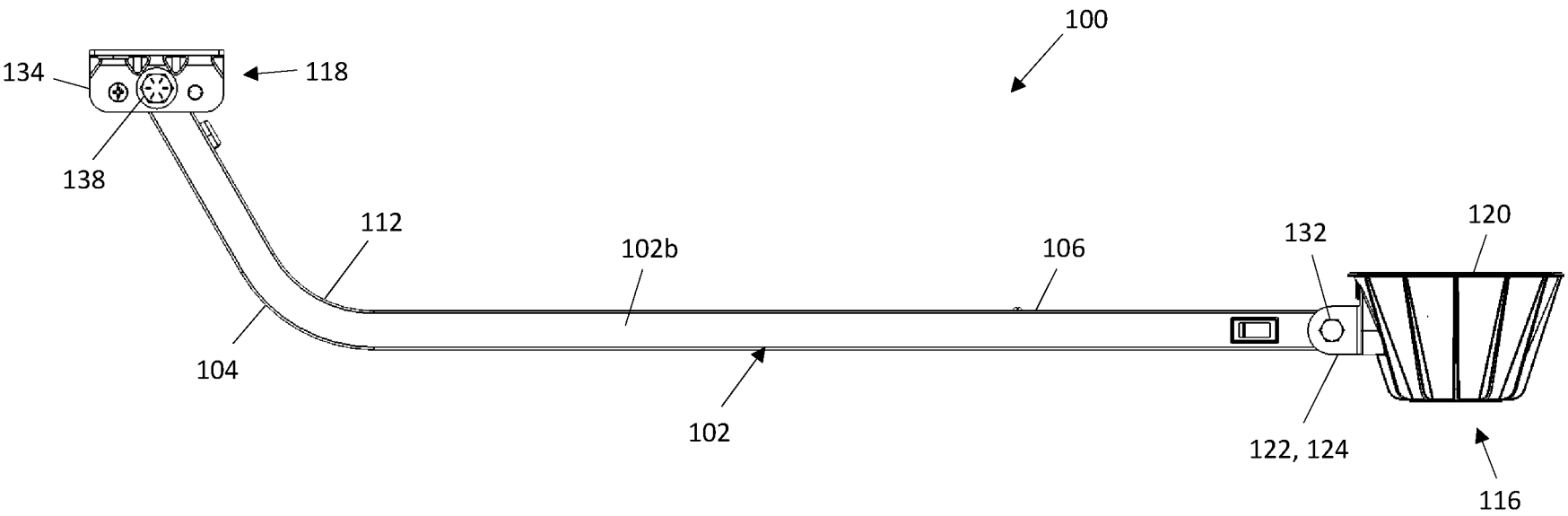
FIG. 5 is a bottom view of the dock light apparatus of FIG. 1.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Referring now to the figures, FIGS. 1-5 illustrate an embodiment of a dock light apparatus 100 including an elongated, bent arm 102 having an axially curved or bent portion 104 and an axially straight portion 106. The axially curved portion 104 terminates at a proximal end 108 of the bent arm 102 and the axially straight portion 106 terminates at a distal end 110 of the bent arm 102. The axially curved portion 104 includes a rigid bend 112. As described in more detail below, the bent arm 102 is configured to support a light fixture 116 proximate its distal end 110. Also, the bent arm 102 may be mounted to a wall at its proximal end 108 using a mounting bracket assembly 118. The rigid bend 112 may be preferably closer to the proximal end 108 than to the distal end 110. When the bent arm 102 is mounted to a wall adjacent to a loading dock door, as described below, the axially curved portion 104 provides clearance around obstructions adjacent the door opening, such as a door track, to allow the axially straight portion 106 to extend unimpeded into the door opening for providing illumination via the light fixture 116.

The bent arm 102 may be made of any suitable material having sufficient strength to support the light fixture 116 and to withstand incidental impacts from forklifts. For example, the bent arm 102 may be made of mechanical steel tubing having a hollow tubular cross section in a rectangular, square, or round shape. The steel tubing may be shaped or bent as required to produce the axially curved or bent portion 104. The bent arm 102 also may have a rigid one-piece construction in that it is formed from a single piece of steel tubing. Alternatively, different portions of the bent arm 102, such as the axially curved portion 104 and the axially straight portion 106, may be integrally formed or connected with each other, for example, by welding separate pieces of steel tubing together, so as to form a continuous rigid structure for the bent arm 102. In other embodiments, the bent arm 102 may have a hinged construction (as described below) in that it is an assembly of discrete components configured to provide flexibility for the bent arm.

Figure 6:
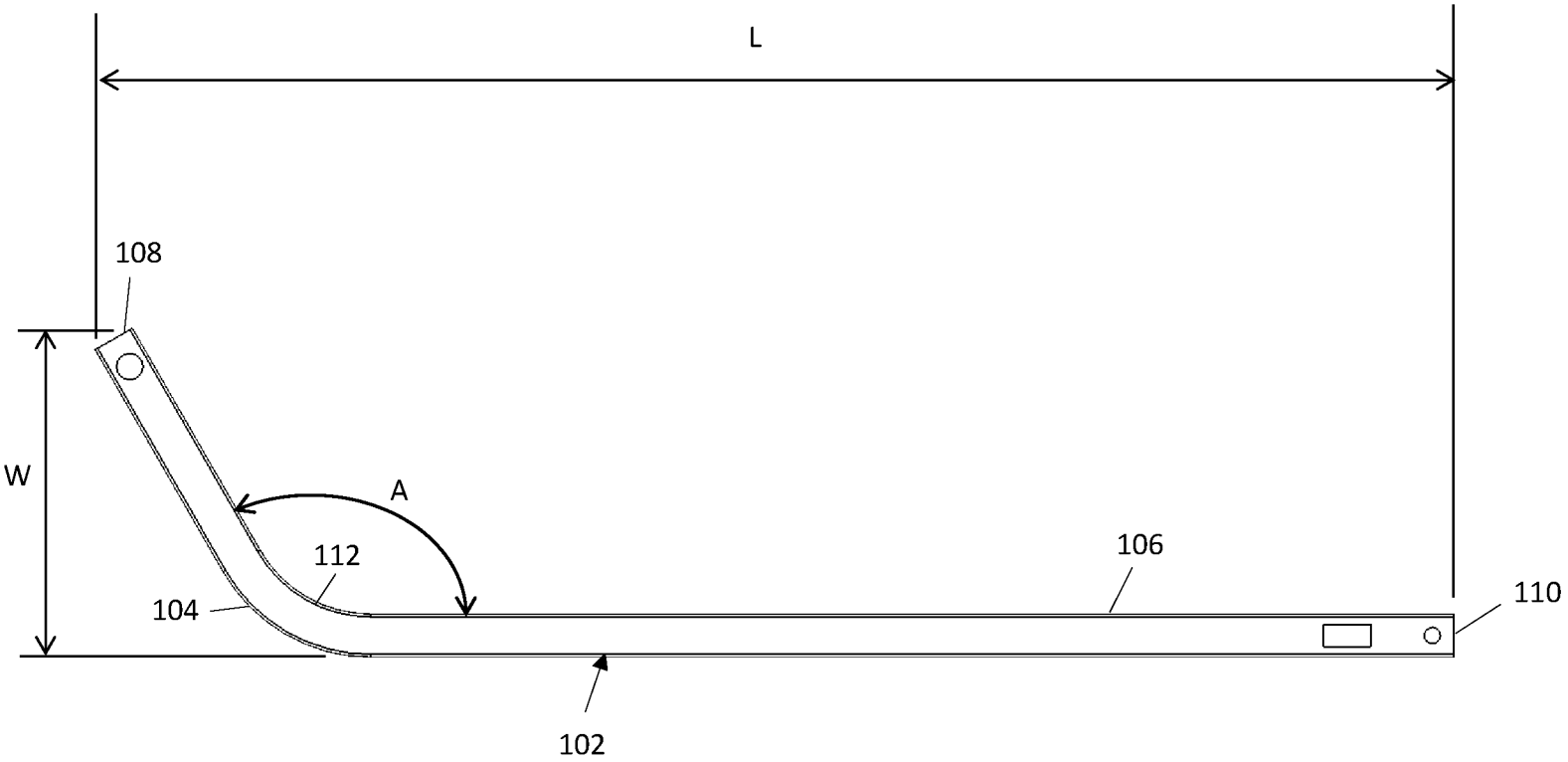
FIG. 6 is a bottom view of the bent arm of the dock light apparatus of FIG. 1.

In the illustrated embodiment, the bent arm 102 is made of 16 gage rectangular steel tubing having a wall thickness of about 0.065" and nominal outside dimensions of 1"×2". It is believed that rectangular steel tubing can offer a mechanical advantage for the bent arm 102 compared to square steel tubing having the same surface area and lower gage by providing additional strength and reducing material weight and cost. The steel tubing may be coated to provide corrosion resistance and a desired appearance. With reference to FIG. 6, the bent arm 102 may have a length L in the range of about 20" to about 40" and a width W in the range of about 6" to about 10". In addition, the rigid bend 112 of the axially curved portion 104 may have a fixed obtuse angle A in the range of about 110 to about 130 degrees.

Figure 7:
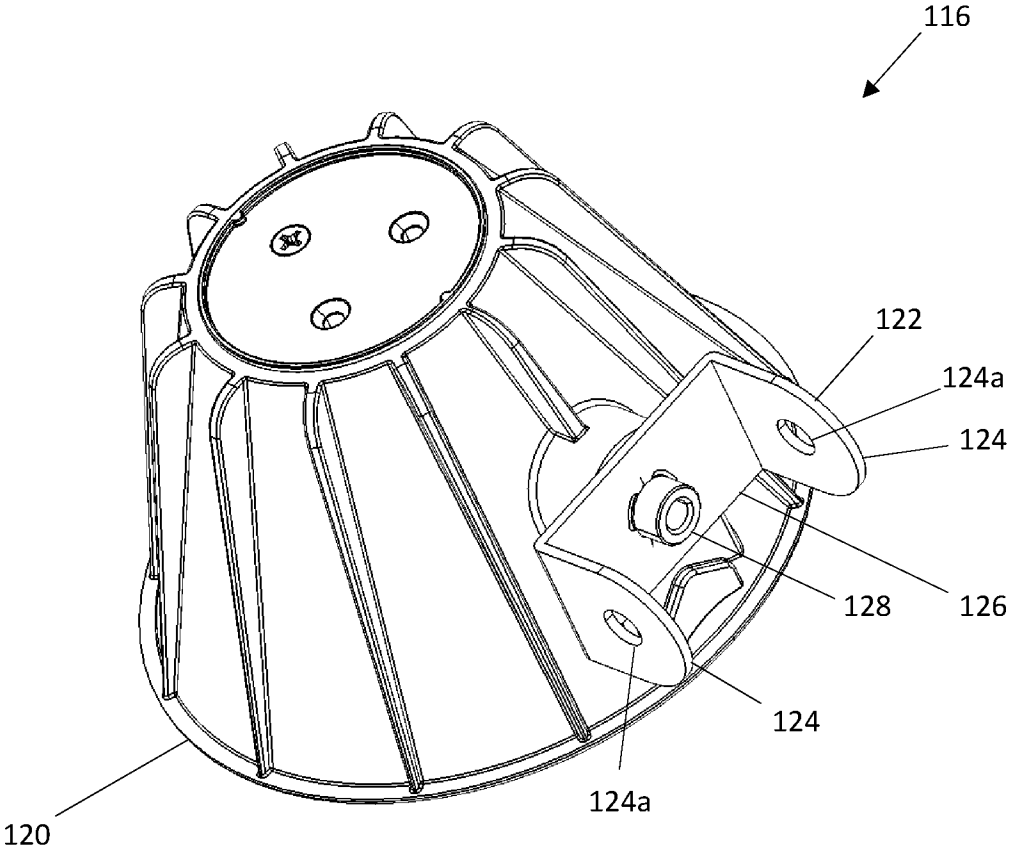
FIG. 7 is a perspective view of the lamp fixture of the dock light apparatus of FIG. 1.
Figure 8:
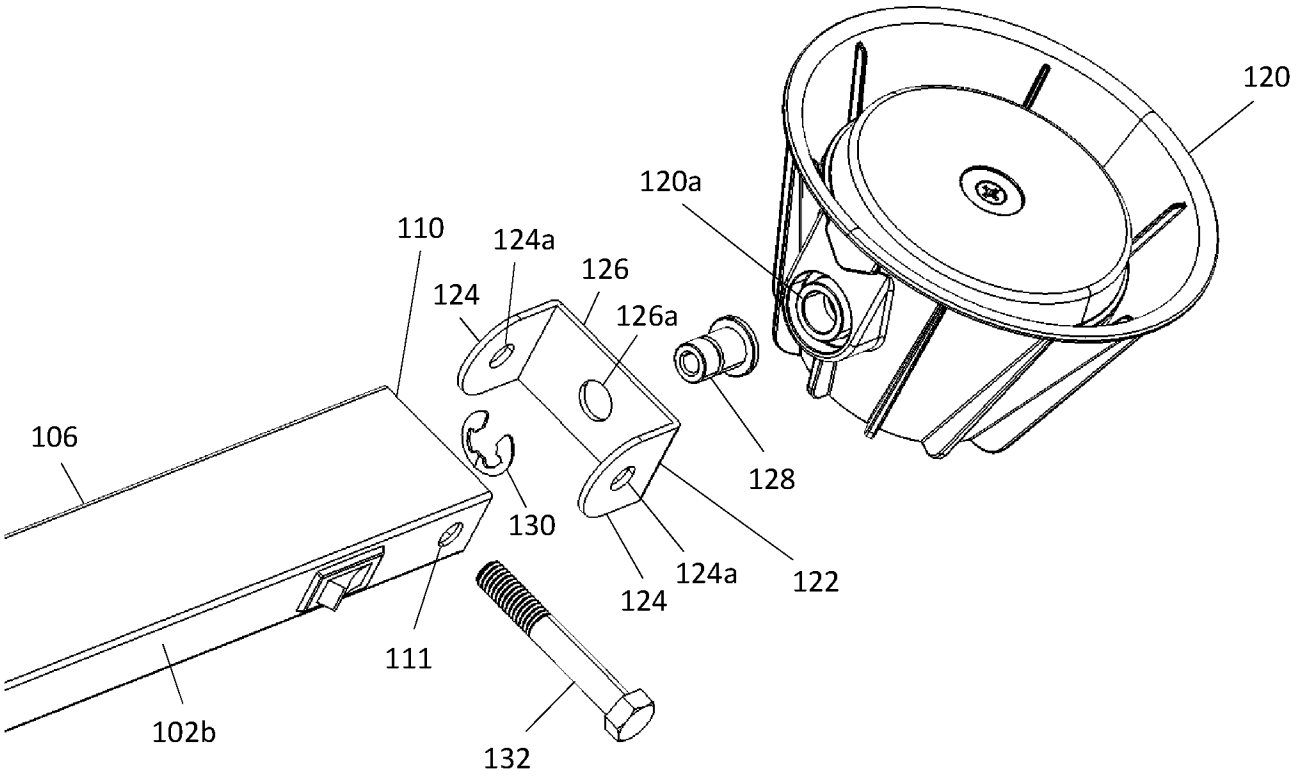
FIG. 8 is an enlarged partially exploded detail view of a portion of the dock light apparatus of FIG. 1, including a lamp fixture.

Referring to FIGS. 7-8, the light fixture 116 may include a lamp head 120 attached to the distal end 110 of the bent arm 102 using a lamp head bracket 122. The lamp head 120 may be an incandescent, high pressure sodium, LED, or any other suitable type of light source. The lamp head bracket 122 may be a U-shaped bracket having a pair of spaced apart parallel legs 124 connected by a transverse leg 126. The parallel legs 124 of the lamp head bracket 122 are formed with axially aligned screw threaded openings **124*a* configured to threadedly receive a threaded lamp bolt 132. Also, a pair of axially aligned distal end holes 111 sized to slidably receive the lamp bolt 132 are formed respectively in a top wall 102*a* and a bottom wall 102*b* of the bent arm 102 proximate the distal end 110. The lamp head bracket 122 is positioned over the distal end 110 of the bent arm 102 so that the screw threaded openings 124***a* are aligned with the distal end holes 111 to secure the lamp bolt 132 projecting therethrough.

In addition, the transverse leg 126 of the lamp head bracket 122 defines a through-hole 126*a* sized to slidably receive a pivot pin 128. The pivot pin 128 is mounted within and projects through an opening 120*a* formed in the sidewall of the lamp head 120. The pivot pin 128 has an axial passage extending therethrough to allow wiring to pass internally from the lamp head 120 into the bent arm 102. For example, the lamp head 102 may be an LED light source that is in electrical communication with an LED driver circuit located inside the bent arm 102 via the electrical connection provided by the wiring passing through the pivot pin 128. A bowed E-ring 130 is installed onto a groove formed on the pivot pin 128 adjacent to the transverse leg 126 on the side opposite the lamp head 120. The bowed E-ring 130 provides a friction fit onto the groove of the pivot pin 128 and generates a pre-load or axial tension pulling the lamp head 120 into engagement with the lamp head bracket 122. This configuration prevents axial movement of the lamp head 120 relative to the lamp head bracket 122 and allows the lamp head 120 to frictionally rotate relative to the lamp head bracket 122 while staying in place.

Figure 9:
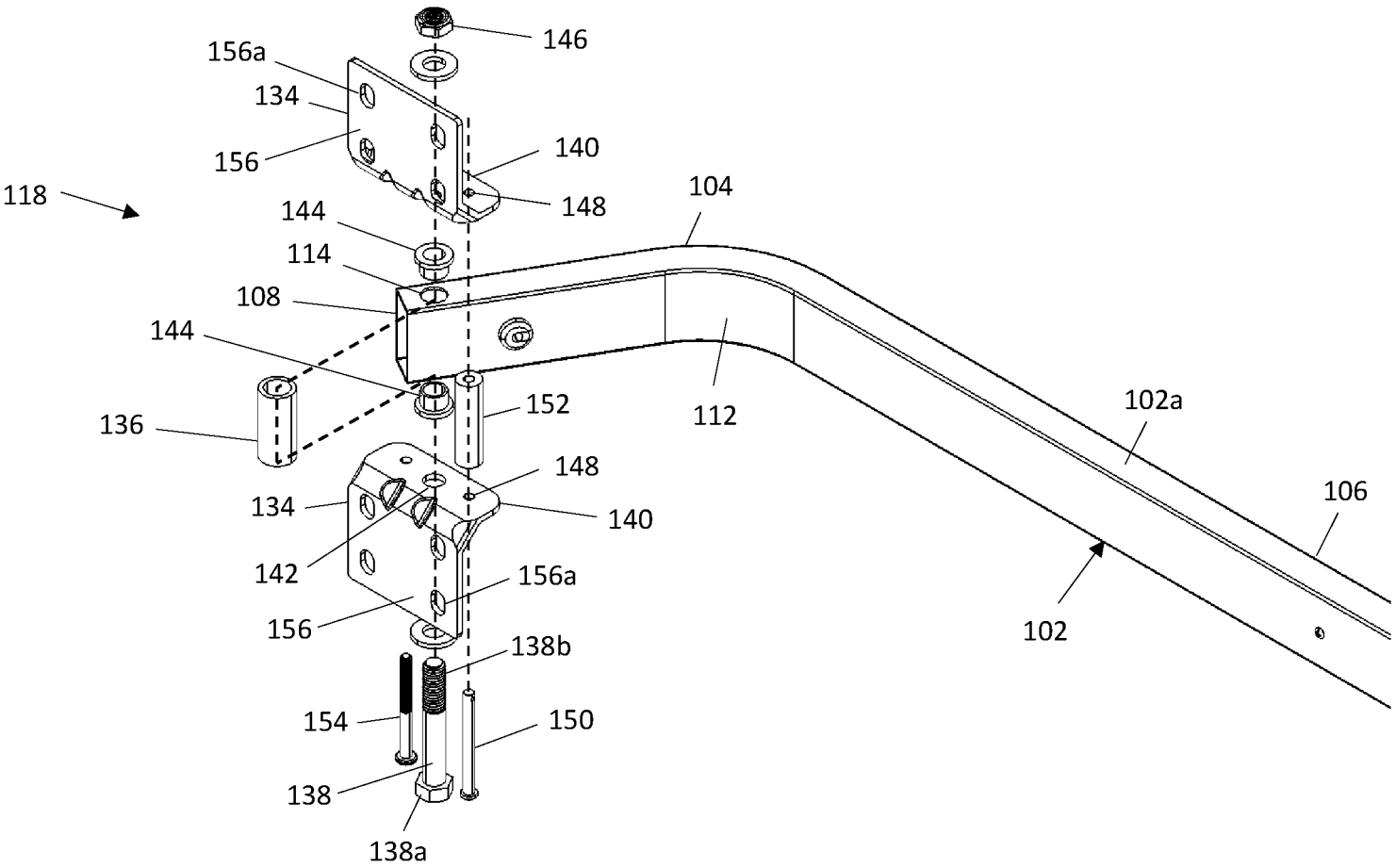
FIG. 9 is an enlarged partially exploded detail view of a portion of the dock light apparatus of FIG. 1, including a mounting bracket assembly.

With reference to FIG. 9, the mounting bracket assembly 118 is attached proximate the proximal end 108 of the bent arm 102. The mounting bracket assembly 118 may include a pair of L-shaped brackets 134 configured to clamp a portion of the bent arm 102 proximate the proximal end 108 therebetween using a mounting bolt 138. More specifically, the mounting bolt 138 includes an enlarged head 138*a* and a shank 138*b* having a screw thread that extends along at least a part of the length of the shank 138*b*. For example, the thread of the shank 138*b* may extend the entire length of the shank 138*b* or only proximate the end of the shank 138*b* opposite the enlarged head 138*a*. Each L-shaped bracket 134 includes a base plate 140 that defines a bolt hole 142 sized to receive the shank 138*b* of the mounting bolt 138. The bent arm 102 includes a pair of oppositely facing bushing holes 114 formed respectively in the top wall 102*a* and the bottom wall 102*b* proximate the proximal end 108 of the bent arm 102. A flange bushing 144 sized to receive the shank 138*b* of the mounting bolt 138 is disposed in each bushing hole 114 to minimize wear of the bushing hole and to improve stability, strength and smoothness of travel for the mounting bolt 138.

The L-shaped brackets 134 are disposed against the top wall 102*a* and the bottom wall 102*b* of the bent arm 102 proximate its proximal end 108 so that the bolt holes 142 of the bracket base plates 140 are aligned axially with the flange bushings 144 received in the bushing holes 114. The shank 138*b* of the mounting bolt 138 is inserted through the bolt holes 142 and the flange bushings 144 so that the enlarged head 138*a* abuts against the bracket base plate 140 of the first L-shaped bracket 134 and the threaded portion of the shank 138*b* extends out of the bolt hole 142 of the second L-shaped bracket 134. A nut 146 is tightened on the threaded portion of the shank 138*b* against the bracket base plate 140 of the second L-shaped bracket 134 to clamp the bent arm 102 between the bracket base plates 140 of the L-shaped brackets 134. In this configuration, the bent arm 102 may rotate relative to the L-shaped brackets 134 about the longitudinal axis of the mounting bolt 138 for positioning the bent arm 102 relative to a door opening, as described below. In addition, a nylon spacer 136 may be disposed over the mounting bolt 138 extending between the bolt holes 142 of the bracket base plates 140 so as to prevent tube crush when the mounting bolt 138 is tightened and to maintain alignment of the flange bushings 144 and L-shaped brackets 134.

Each base plate 140 of the L-shaped brackets 134 may also include one or more clevis pin holes 148 sized to removably receive a clevis pin 150 therein. In the illustrated embodiment, each base plate 140 includes two clevis pin holes 148 that are formed symmetrically on opposite sides of the bolt hole 142 such that when a pair of L-shaped brackets 134 are mounted to the bent arm 102 using the mounting bolt 138 as described above, each clevis pin hole 148 of the first L-shaped bracket 134 is coaxially aligned a clevis pin hole 148 of the second L-shaped bracket 134. A clevis pin 150 may be inserted through at least a first pair of coaxially aligned clevis pin holes 148 to limit the rotation of the bent arm 102, as described below. Further, a nylon spacer 152 extending between the clevis pin holes 148 may be disposed over the clevis pin 150 to prevent tube crush when the mounting bolt 138 is tightened. Also, an additional securing bolt 154 may be inserted through a second pair of coaxially aligned clevis pin holes 148 to provide additional strength and stability for the mounting bracket assembly 118.

Figure 10:
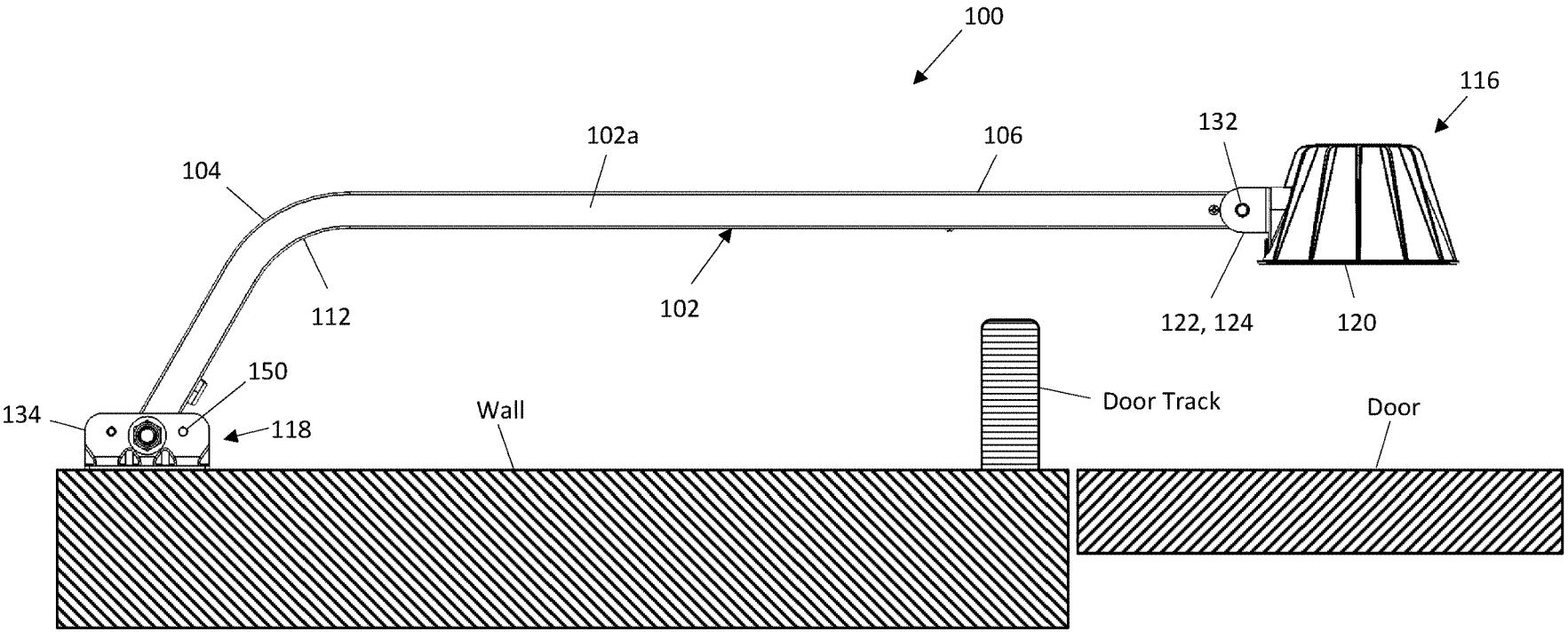
FIG. 10 is a top view of the dock light apparatus of FIG. 1 mounted to a wall of a loading dock.

In addition, each L-shaped bracket 134 includes a mounting plate 156 that defines one or more mounting holes 156*a* for fastening the L-shaped bracket 134 to a building wall with conventional fasteners. With reference to FIG. 10, the bent arm 102 may be mounted to a wall adjacent to a loading dock door. Loading dock doors frequently have rollers which ride in vertical door tracks for smoother operation. The door tracks are attached to the interior of the loading dock wall along each side of the door opening. When the bent arm 102 is mounted to an interior wall of a loading dock adjacent to a loading dock door, the bent arm 102 may be rotated about the longitudinal axis of the mounting bolt 138 so that the axially straight portion 106 is disposed parallel to the wall. The axially curved portion 104 bends sufficiently around the door track to provide clearance for the axially straight portion 106 to extend into the door opening for illuminating the inside of a docked trailer via the light fixture 116. The clevis pin 150 limits the rotation of the bent arm 102, causing the bent arm to remain parallel to the wall and avoiding ingress of the bent arm 102 into the path of the door. This prevents the dock light apparatus 100 from being damaged by the door when it travels between different positions.

Figure 11:
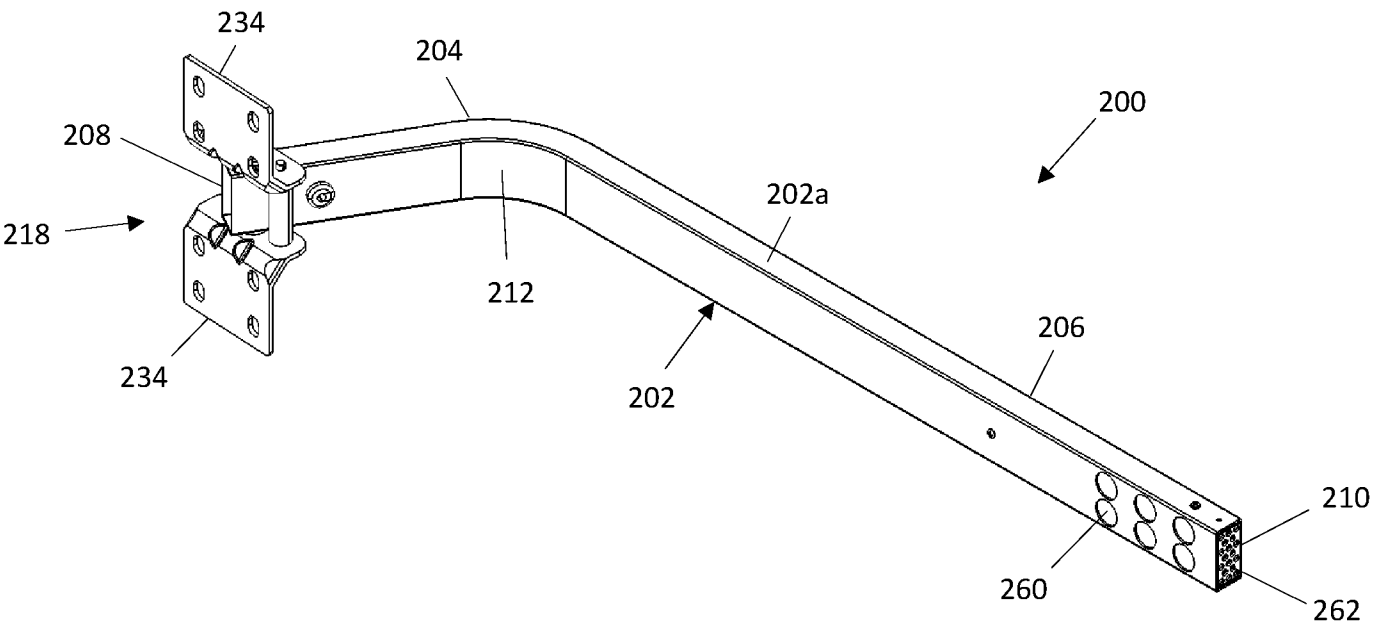
FIG. 11 is a perspective view of a dock light apparatus in accordance with another embodiment of the present disclosure.
Figure 12:
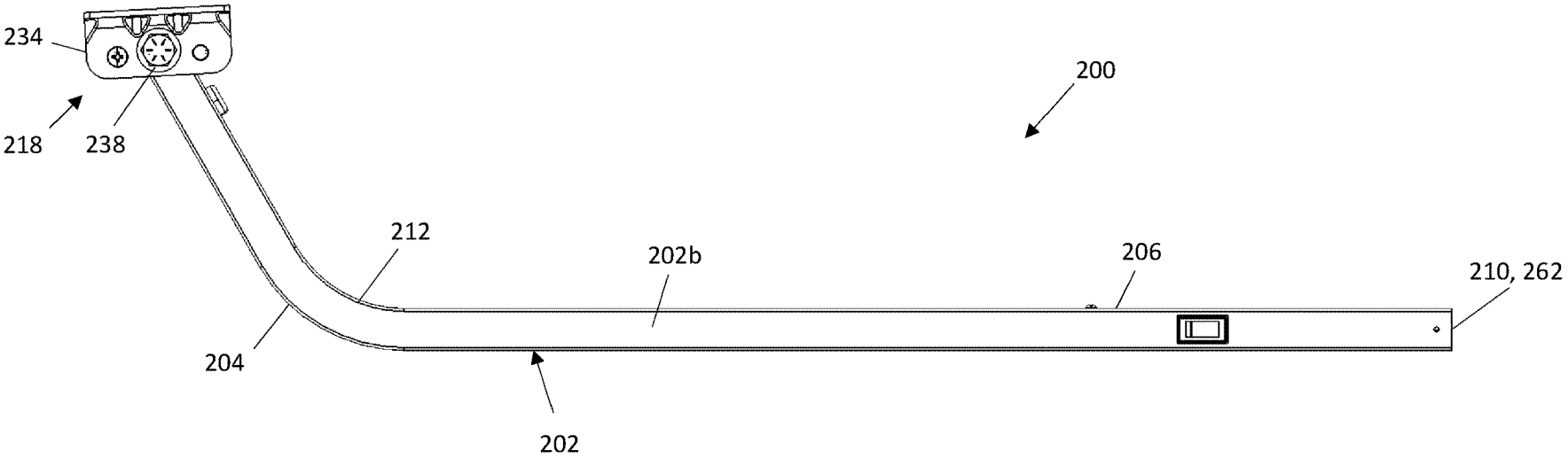
FIG. 12 is a bottom view of the dock light apparatus of FIG. 11.
Figure 13:
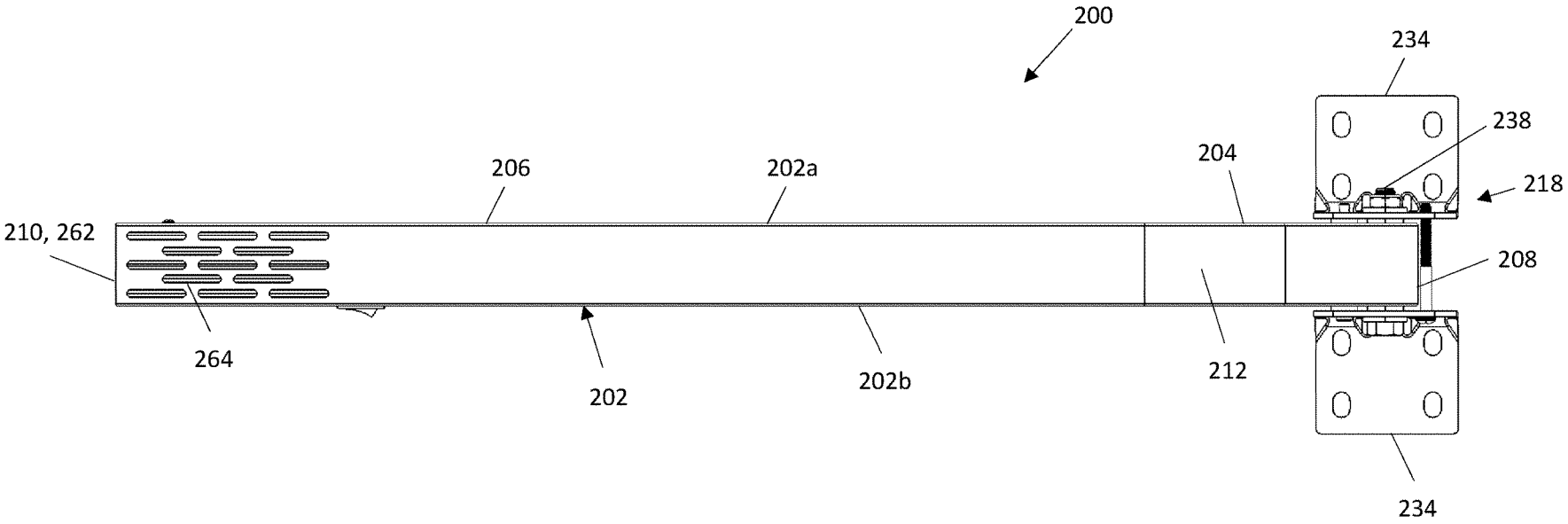
FIG. 13 is a rear view of the dock light apparatus of FIG. 11.

In another embodiment, as illustrated in FIGS. 11-13, a dock light apparatus 200 may include an elongated, bent arm 202 made of mechanical steel tubing having a hollow tubular cross section in a rectangular shape. The bent arm 202 includes an axially curved or bent portion 204 and an axially straight portion 206. The axially curved portion 204 defines a proximal end 208 of the bent arm 202 and the axially straight portion 206 defines a distal end 210 of the bent arm 202. The axially curved portion 204 includes a rigid bend 212. The bent arm 202 may be mounted to a wall at its proximal end 208 using a mounting bracket assembly 218. The mounting bracket assembly 118 may include a pair of L-shaped brackets 234 configured to clamp a portion of the bent arm 202 proximate the proximal end 208 therebetween using a mounting bolt 238. Components of the dock light apparatus 200 that are similar to those of the dock light apparatus 100 (FIGS. 1-10) are designated with like reference numerals and a duplicate description is omitted here.

In the embodiment illustrated in FIGS. 11-13, a light fixture 260 comprising a LED light source is mounted within the hollow interior of the bent arm 202 proximate its distal end 210. The light fixture 260 includes an end cap 262 attached at the distal end 210 of the bent arm 202 and having a plurality of exhaust openings formed therein to provide ventilation. The light fixture 260 may include a built-in power supply, such as a battery, or may be powered by an external AC power source or other suitable power source.

The bent arm 202 includes one or more LED openings formed in a sidewall thereof to allow light emitted by the light fixture 260 to pass through and provide illumination. The bent arm 202 also may include one or more ventilation openings formed in a second sidewall thereof to allow heat generated by the light fixture 260 to dissipate to the atmosphere. When the bent arm 202 is mounted to a wall adjacent to a loading dock door, the axially curved portion 204 again provides sufficient clearance around obstructions adjacent the door opening, such as a door track, to provide clearance for the axially straight portion 206 to extend unimpeded into the door opening and illuminate the inside of a docked trailer via the light fixture 260.

What is claimed is:

1. A dock light apparatus for mounting to a vertical wall adjacent to a loading dock door, the dock light apparatus comprising:

a light fixture;

an elongated arm including an axially straight portion coupled to an axially curved portion having a rigid bend; and a bracket assembly configured to mount the elongated arm to a vertical wall in a horizontal plane relative to the wall, the bracket assembly including a stop pin configured to limit rotation of the elongated arm for avoiding ingress of the elongated arm into a travel path of the loading dock door, wherein the axially curved portion is configured to couple to the bracket assembly at a proximal end of the axially curved portion for providing clearance around an obstruction on the vertical wall adjacent the loading dock door and the axially straight portion is configured to extend unimpeded into an opening for the loading dock door formed in the vertical wall and to support the light fixture proximate to a distal end of the axially straight portion.

2. The dock light apparatus of claim 1, wherein the axially curved portion is configured to rotatably couple to the bracket assembly.

3. The dock light apparatus of claim 1, wherein the axially curved portion is configured to rotate relative to the bracket assembly to position the axially straight portion parallel to the wall.

4. The dock light apparatus of claim 1, wherein the bracket assembly includes a pair of brackets configured to clamp a portion of the axially curved portion therebetween via a mounting bolt to allow the elongated arm to rotate about a pivot axis defined by the mounting bolt.

5. The dock light apparatus of claim 1, wherein the rigid bend forms an obtuse angle.

6. The dock light apparatus of claim 1, wherein the elongated arm has a rigid one-piece construction.

7. The dock light apparatus of claim 1, wherein the elongated arm is formed from a single piece of steel tubing having a rectangular cross section shape.

8. The dock light apparatus of claim 1, wherein the light fixture includes a light source mounted within a hollow interior of the elongated arm and the elongated arm includes a sidewall having at least one opening configured to allow light emitted by the light source to pass through.

9. A dock light apparatus comprising:

a light fixture;

an elongated arm having a proximal end, a distal end, an axially curved portion that includes a rigid bend and terminates at the proximal end, and an axially straight portion that terminates at the distal end; and a bracket assembly configured to attach to a vertical wall and including a stop pin configured to limit rotation of the elongated arm, wherein the axially curved portion is configured to rotatably couple to the bracket assembly about a vertical pivot axis such that the elongated arm extends in a horizontal plane when the bracket assembly is attached to the wall and the axially straight portion is configured to support the light fixture.

10. The dock light apparatus of claim 9, wherein the axially curved portion and the bracket assembly are configured to cooperate with each other to position the axially straight portion parallel to the wall when the bracket assembly is attached to the wall.

11. The dock light apparatus of claim 9, wherein the bracket assembly includes a pair of brackets configured to clamp a portion of the axially curved portion therebetween via a mounting bolt that defines the pivot axis.

12. The dock light apparatus of claim 9, wherein the rigid bend forms an obtuse angle.

13. The dock light apparatus of claim 9, wherein the elongated arm has a rigid one-piece construction.

14. The dock light apparatus of claim 9, wherein the elongated arm is formed from a single piece of steel tubing having a rectangular cross section shape.

15. The dock light apparatus of claim 9, wherein the light fixture includes a light source mounted within a hollow interior of the elongated arm and the elongated arm includes a sidewall having at least one opening configured to allow light emitted by the light source to pass through.

16. A dock light apparatus comprising:

an elongated arm having a proximal end, a distal end, an axially curved portion that includes a rigid bend and terminates at the proximal end, and an axially straight portion that terminates at the distal end;

a light fixture including a light source mounted within a hollow interior of the elongated arm and the elongated arm includes a sidewall having at least one opening configured to allow light emitted by the light source to pass through; and a bracket assembly configured to attach to a vertical wall, wherein the axially curved portion is configured to rotatably couple to the bracket assembly about a vertical pivot axis such that the elongated arm extends in a horizontal plane when the bracket assembly is attached to the wall and the axially straight portion is configured to support the light fixture.

17. The dock light apparatus of claim 16, wherein the axially curved portion and the bracket assembly are configured to cooperate with each other to position the axially straight portion parallel to the wall when the bracket assembly is attached to the wall.

18. The dock light apparatus of claim 16, wherein the bracket assembly includes a pair of brackets configured to clamp a portion of the axially curved portion therebetween via a mounting bolt that defines the pivot axis.

19. The dock light apparatus of claim 16, wherein the bracket assembly includes a stop pin configured to limit rotation of the elongated arm.

20. The dock light apparatus of claim 16, wherein the rigid bend forms an obtuse angle.

* * * * *